US007926572B2

(12) United States Patent
Erkol et al.

(10) Patent No.: US 7,926,572 B2
(45) Date of Patent: Apr. 19, 2011

(54) BALLISTICALLY COMPATIBLE BACKPRESSURE VALVE

(75) Inventors: Zafer Erkol, Sugar Land, TX (US); Gokturk Tunc, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 573 days.

(21) Appl. No.: 12/062,564

(22) Filed: Apr. 4, 2008

(65) Prior Publication Data

US 2009/0250223 A1 Oct. 8, 2009

(51) Int. Cl.
*E21B 34/06* (2006.01)

(52) U.S. Cl. ..... 166/373; 166/381

(58) Field of Classification Search ..... 166/373, 166/381, 63, 165, 334.2; 251/314, 299, 301, 251/208

See application file for complete search history.

(56) References Cited

U.S. PATENT DOCUMENTS

| | | | | |
|---|---|---|---|---|
| 3,086,587 | A * | 4/1963 | Solis et al. | 166/284 |
| 6,354,374 | B1 * | 3/2002 | Edwards et al. | 166/297 |
| 6,742,597 | B2 | 6/2004 | Van Winkle et al. | |
| 6,808,023 | B2 | 10/2004 | Smith et al. | |
| 6,834,722 | B2 | 12/2004 | Vacik et al. | |
| 6,889,771 | B1 | 5/2005 | Leising et al. | |
| 6,976,542 | B2 | 12/2005 | Henriksen et al. | |
| 7,134,488 | B2 | 11/2006 | Tudor et al. | |
| 7,243,727 | B2 | 7/2007 | Tudor et al. | |
| 7,793,732 | B2 * | 9/2010 | Xu et al. | 166/386 |
| 2009/0045368 | A1 * | 2/2009 | Cowie et al. | 251/315.16 |

* cited by examiner

*Primary Examiner* — Daniel P Stephenson
(74) *Attorney, Agent, or Firm* — Michael L. Flynn; David Hofman; Robin Neva

(57) ABSTRACT

A backpressure valve. The backpressure valve may be configured to maintain a substantially controlled pressure in coiled tubing uphole thereof while simultaneously being compatible with a ballistically actuated tool downhole thereof. The valve may include a housing with an uphole chamber in alignment with the coiled tubing and downhole chamber in alignment with the ballistically actuated tool. A gate mechanism disposed between the uphole and downhole chambers may thus be employed to receive a ballistic actuator from the uphole chamber for dispensing into the downhole chamber without sacrifice to pressure control within the coiled tubing.

23 Claims, 6 Drawing Sheets

BALLISTICALLY COMPATIBLE BACKPRESSURE VALVE

FIELD OF THE INVENTION

Embodiments described relate to coiled tubing for use in hydrocarbon wells. In particular, embodiments of coiled tubing are described utilizing a backpressure valve to maintain a pressure differential between the coiled tubing and a downhole environment in a well. Additionally, such coiled tubing may also be employed with a ballistically actuated downhole tool at the end thereof.

BACKGROUND OF THE RELATED ART

Exploring, drilling and completing hydrocarbon and other wells are generally complicated, time consuming and ultimately very expensive endeavors. As a result, over the years well architecture has become more sophisticated where appropriate in order to help enhance access to underground hydrocarbon reserves. For example, as opposed to wells of limited depth, it is not uncommon to find hydrocarbon wells exceeding 30,000 feet in depth. Furthermore, as opposed to remaining entirely vertical, today's hydrocarbon wells often include deviated or horizontal sections aimed at targeting particular underground reserves.

While such well depths and architecture may increase the likelihood of accessing underground hydrocarbons, other challenges are presented in terms of well management and the maximization of hydrocarbon recovery from such wells. For example, during the life of a well, a variety of well access applications may be performed within the well with a host of different tools or measurement devices. However, providing downhole access to wells of such challenging architecture may require more than simply dropping a wireline into the well with the applicable tool located at the end thereof. Thus, coiled tubing is frequently employed to provide access to wells of such challenging architecture.

Coiled tubing operations are particularly adept at providing access to highly deviated or tortuous wells where gravity alone fails to provide access to all regions of the wells. During a coiled tubing operation, a spool of pipe (i.e., a coiled tubing) with a downhole tool at the end thereof is slowly straightened and forcibly pushed into the well. This may be achieved by running coiled tubing from the spool and through a gooseneck guide arm and injector which are positioned over the well at the oilfield. In this manner, forces necessary to drive the coiled tubing through the deviated well may be employed, thereby delivering the tool to a desired downhole location.

As the coiled tubing is driven into the well as described, a degree of fluid pressure may be provided within the coiled tubing. At a minimum, this pressure may be enough to ensure that the coiled tubing maintains integrity and does not collapse. However, in many cases, the downhole application and tool may require pressurization that substantially exceeds the amount of pressure required to merely ensure coiled tubing integrity. As a result, measures may be taken to prevent fluid leakage from the coiled tubing and into the well. As described below, the importance of these measures may increase as the disparity between the high pressure in the coiled tubing and that of the surrounding well environment also increases.

For example, it would not be uncommon for a low pressure well of about 2,000 PSI or so to accommodate coiled tubing at a depth of about 10,000 feet. Due to the depth, if the coiled tubing is filled with a fluid such as water, hydrostatic pressure exceeding about 4,350 PSI would be found at the terminal end of the coiled tubing. That is, even without any added pressurization, the column of water within the coiled tubing will display pressure at the end of the coiled tubing that exceeds the surrounding pressure of the well by over 2,000 PSI. Therefore, in order to prevent uncontrolled leakage of fluid into the well from the coiled tubing, a backpressure valve may be located at the terminal end of the coiled tubing. In this manner, uncontrolled leakage may be avoided, for example, to avoid collapse of the coiled tubing as noted above, to allow for effective pulse telemetry through the coiled tubing, and for a host of other purposes.

In many circumstances, downhole tools may be provided downhole of the backpressure valve. For example, a clean out tool configured for washing out debris within the well may be coupled to the backpressure valve. For such an application, pressure may be actively provided through the coiled tubing from surface equipment at the oilfield. As such, the backpressure valve may be remotely controlled so as to allow a controlled flow of pressurized fluid through to the clean out tool for the application.

Unlike the above-noted clean out tool however, certain downhole tools require the use of a ballistic actuator such as a spherical ball, dart, or other mechanical projectile which is dropped into the coiled tubing at the surface of the oilfield. In these applications, the ballistic actuator may make its way downhole in accordance with any fluid flow through the coiled tubing with the purpose of reaching and mechanically activating a firing head of the downhole tool. For example, downhole perforating guns are often fired by this technique. Thus, rather than rely on fluid flow and pressurization to activate a perforating gun, the described ballistic actuator is dropped through the coiled tubing line with the purpose of reaching a firing head of the gun to mechanically effect its firing into the wall of the well.

Unfortunately, as detailed above, a backpressure valve may be disposed between the coiled tubing and the downhole tool. As indicated, this may not be of particular concern where the downhole tool is a hydraulic clean out tool. However, for a downhole tool that requires activation by a ballistic actuator, such as the above noted perforating gun, this is not the case. That is, the presence of a backpressure valve at the end of the coiled tubing prevents the ballistic actuator from reaching the perforating gun. As a result, downhole tools actuated by a ballistic actuator may be avoided where coiled tubing that includes a backpressure valve at its terminal end is employed. Thus, as a practical matter, where a pressure differential between the well and coiled tubing is significant enough to require use of a backpressure valve, ballistically actuated downhole tools may not be effectively employed in the operation.

SUMMARY

A backpressure valve is provided to substantially maintain controlled pressure in coiled tubing disposed within a well. The valve may have a housing with an uphole portion for coupling to the coiled tubing and a downhole portion for coupling to a downhole tool. A gate mechanism may be disposed within the housing to receive a ballistic actuator from within the uphole portion and to dispense the ballistic actuator to within the downhole portion for actuation of the downhole tool. Furthermore, the gate mechanism may be provided in the form of a rotable cam having a seat for accommodating the ballistic actuator.

DETAILED DESCRIPTION

Embodiments are described with reference to certain coiled tubing operations employing a backpressure valve and a ballistically actuated downhole tool in combination. In particular, a coiled tubing assembly employing a backpressure valve uphole of a ballistically actuated perforating gun is described in detail. However, a variety of ballistically actuated downhole tools may be employed in conjunction with embodiments of the ballistically compatible backpressure valve as detailed herein.

Figure 1:
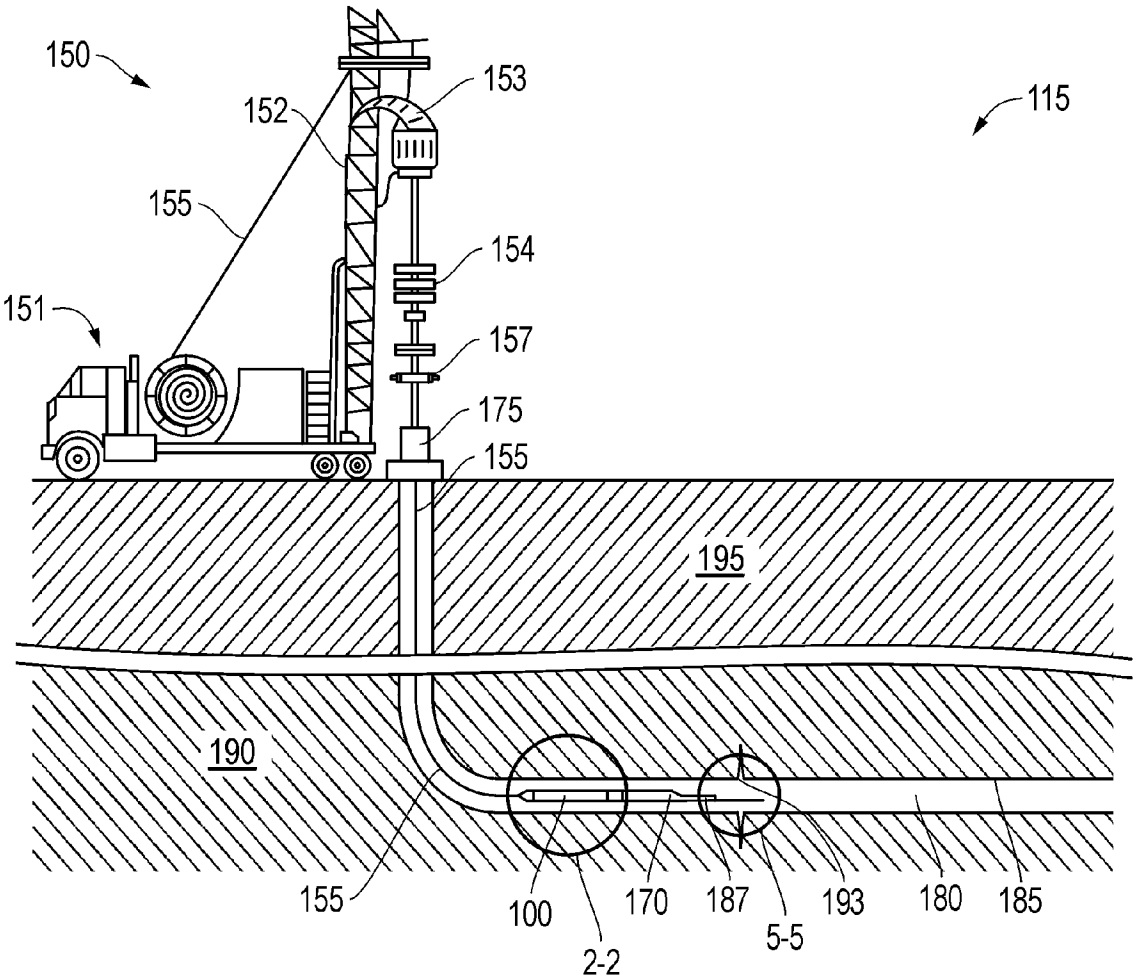
FIG. 1 is an overview of a coiled tubing assembly at an oilfield employing an embodiment of a ballistically compatible backpressure valve.

Referring now to FIG. 1, a coiled tubing assembly is depicted at an oilfield 115. The assembly includes coiled tubing 155 for positioning downhole in a well 180 along with a ballistically actuated perforating gun 187 at the end of the assembly. However, in spite of the use of this ballistically actuated tool, a ballistically compatible backpressure valve (BCBV) 100 is disposed uphole within the assembly in order to control hydrostatic pressure within the coiled tubing 155. As such, significant leakage of fluid from the coiled tubing 155 into a comparatively low pressure well 180 may be avoided. Nevertheless, a conventional mechanical projectile may be dropped into the coiled tubing 155 at the surface of the oilfield 115 and utilized to activate the perforating gun 187 downhole of the BCBV 100 (see the ballistic actuator 300 of FIGS. 3B and 3C).

Continuing with reference to FIG. 1, surface equipment 150 is shown at the oilfield for delivery and management of the coiled tubing operation. The surface equipment 150 includes a conventional coiled tubing truck 151 for mobile transport and delivery of the coiled tubing 155 to the site at the oilfield 115. The coiled tubing 155 may be spooled out from the coiled tubing truck 151 and through an injector assembly 153 supported by a tower 152 at the truck 151. The injector assembly 153 may be employed to drive the coiled tubing 155 through a blowout preventor stack 154, master control valve 157, well head 175, and/or other surface equipment 150 and into the well 180.

The injector assembly 153 is configured to drive the coiled tubing 155 with force sufficient to overcome the deviated nature of the well 180. For example, as depicted in FIG. 1, the coiled tubing 155 is forced through various formation layers 195, 190 and around a bend in the well 180 to the horizontal position shown. The driving forces supplied by the injector assembly 153 are sufficient to overcome any resistance imparted on the coiled tubing 155 and other downhole equipment (100, 170, 187) by the well wall 185 as the assembly traverses the bend in the well 180. In the embodiment shown, delivery of the assembly in this manner is used to position a perforating gun 187 at a desired location as alluded to above and detailed further below. In this manner, the gun 187 may be employed to induce perforations 193 into the formation 190.

Figure 2:
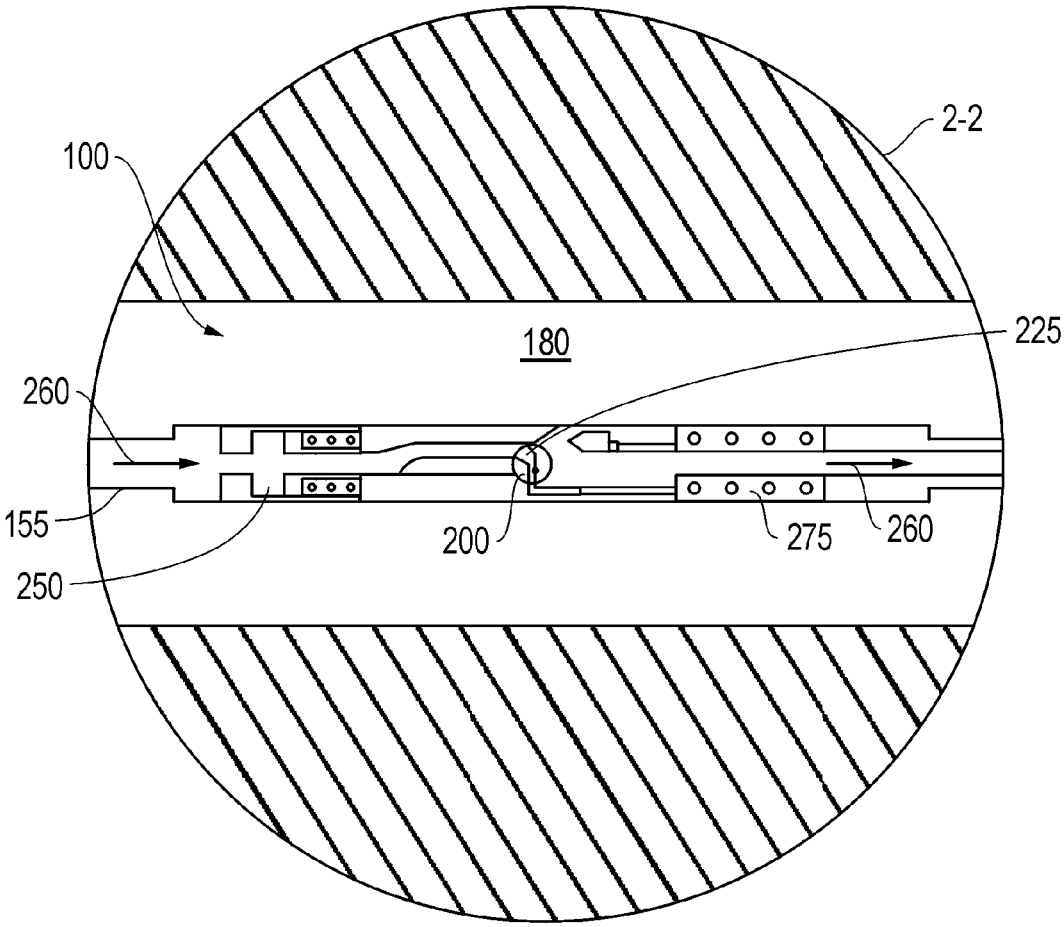
FIG. 2 is an enlarged cross-sectional view of the ballistically compatible backpressure valve taken from 2-2 of FIG. 1.

Continuing now with reference to FIG. 2, with added reference to FIG. 1, an enlarged cross sectional view of the BCBV 100 is shown in the well 180. The BCBV 100 performs the backpressure valve function of providing controlled regulation of a flow of fluid 260 through the assembly. As such, pressure within the coiled tubing 155 may be maintained at a desired level irrespective of potentially low pressure at the outside environment of the well 180. For example, in one embodiment, the BCBV 100 may be employed to maintain a pressure disparity of between about 500 PSI and about 4,000 PSI between the coiled tubing 155 and the well 180.

The BCBV 100 may be equipped with a gate mechanism 200. In the embodiment shown, the gate mechanism 200 is a rotable cam with a defined passageway therethrough. However, other configurations of the gate mechanism 200 may be employed. Regardless, when in a closed position, the gate mechanism 200 may be utilized to substantially close off and isolate the assembly from the outside environment of the well 180. Alternatively, where fluid is pumped into the assembly from surface equipment 150 (see FIG. 1), it may be desirable to allow a degree of fluid release into the well 180. Thus, the gate mechanism 200 may be controllably opened so as to regulate fluid flow 260 from the assembly while maintaining sufficient hydrostatic pressure therein.

Continuing with reference to FIG. 2, operation of the gate mechanism 200 is directed through interaction with an uphole piston assembly 250 and a downhole piston assembly 275. Each piston assembly 250, 275 includes a chamber housing a spring that is employed to position a piston relative to the gate mechanism 200. As detailed in FIGS. 3A-3C and described further below, pre-set and controlled pressures within the BCBV 100 may be employed in directing these pistons to effect opening and closing of the gate mechanism 200.

With added reference to FIG. 1, the above described BCBV 100 is positioned between the coiled tubing 155 and a ballistically actuated tool (e.g. the perforating gun 187 and its firing head 170). However, the gate mechanism 200 may be configured such that a defined passageway is provided therethrough. Thus, when fluid is driven through the coiled tubing 155, the gate mechanism 200 may be configured for alignment of the pathway with the resulting flow of fluid 260 through the BCBV 100. That is, as depicted in FIG. 2, the passageway through the gate mechanism 200 is aligned with both uphole and downhole portions of the BCBV 100. As such, fluid pumped through the assembly may reach the ballistically actuated tool downhole of the BCBV 100. In fact, as detailed in FIGS. 3A-3C and described below, a mechanical ballistic actuator 300 may follow the flow of fluid 260 through to a seat 225 of the gate mechanism 200 from which it may then be further transported downhole. Thus, the gate mechanism 200 provides ballistic compatibility to the BCBV 100.

Figure 3A:
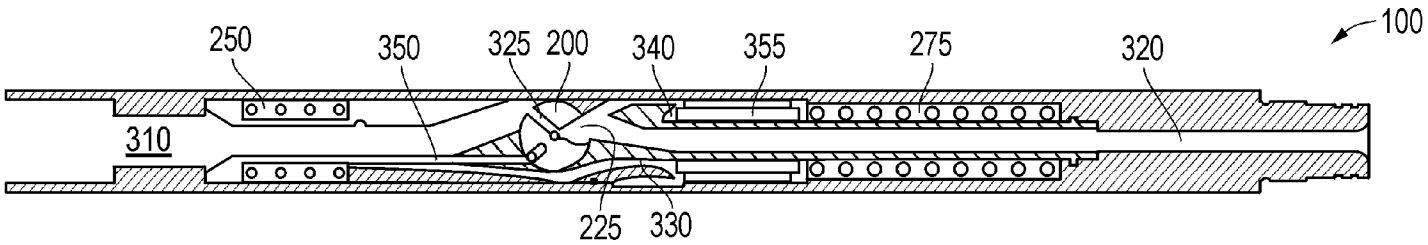
FIG. 3A is a depiction of the ballistically compatible backpressure valve of FIG. 2 revealing a gate mechanism in an initial closed position.
Figure 3B:
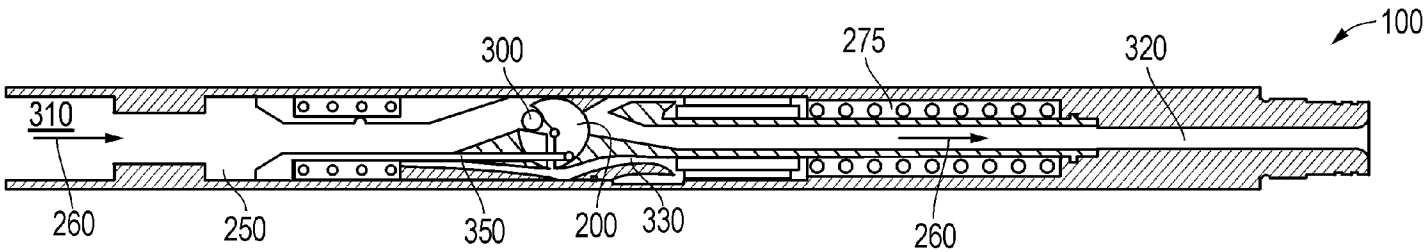
FIG. 3B is a depiction of the ballistically compatible backpressure valve of FIG. 2 with the gate mechanism in an open position accommodating a ballistic actuator.
Figure 3C:
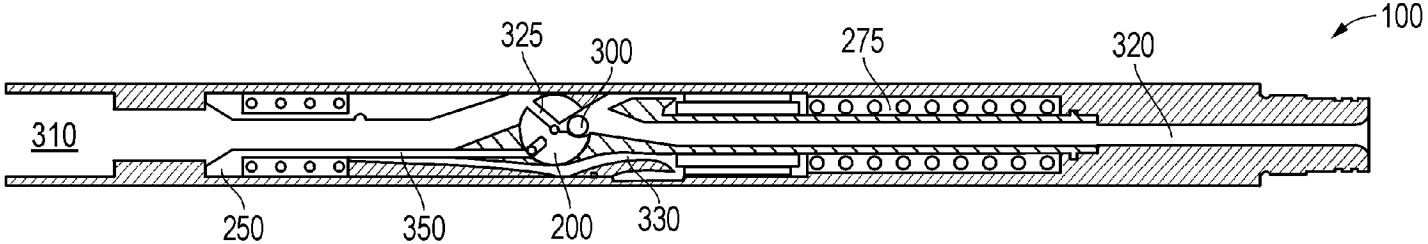
FIG. 3C is a depiction of the ballistically compatible backpressure valve of FIG. 2 with the gate mechanism in a subsequent closed position for releasing the ballistic actuator.

Continuing now with reference to FIGS. 3A-3C, a closer examination of the BCBV 100 is depicted. In these depictions, the gate mechanism 200 changes positions from an initially closed position (FIG. 3A), to an open position for receiving the ballistic actuator 300 (FIG. 3B), and to a subsequent closed position for releasing the ballistic actuator 300 downhole (FIG. 3C). In the embodiment depicted, the gate mechanism 200 is a rotable cam such that the indicated positions are achieved as the cam is rotated from position to position as guided by an uphole piston arm 350 of the uphole piston assembly 250. However, alternate embodiments of a gate mechanism 200 may be employed to provide a backpressure valve that is ballistically compatible with a ballistically actuated downhole tool. For example, in one embodiment, the gate mechanism 200 may be configured in a non-rotable manner. This may include an embodiment of a gate mechanism 200 in the form of a chamber that is alternatingly open to uphole and downhole portions of the BCBV 100 (see chambers 310, 320) so as to transfer the ballistic actuator 300 from the uphole portion (e.g. chamber 310) of the BCBV 100 to the downhole portion (e.g. chamber 320) of the BCBV 100.

Returning to reference to FIG. 3A, the gate mechanism 200 of the embodiment shown is depicted in an initially closed position. In this position, an uphole chamber 310 of the BCBV 100 is substantially closed off from a downhole chamber 320 of the BCBV 100. The position of the gate mechanism 200 is maintained by the uphole piston arm 350. The uphole piston arm 350 in turn is maintained in the position shown by a conventional spring and piston head within a chamber of the uphole piston assembly 350. Thus, the initial closed position is maintained where pressure in the uphole chamber 310 is insufficient to overcome the spring of the uphole piston assembly 350. For example, the closed position may be maintained where pressure in the uphole chamber 310 fails to overcome the spring of the uphole piston assembly 350. Furthermore, as described below, the closed position of the gate mechanism 200 corresponds with the BCBV 100 serving as a conventional backpressure valve as directed through an intentional leak point 340 detailed below. That is, with the gate mechanism in the position shown, leakage of fluid from within the uphole chamber 310 to the downhole chamber 320 and into the well 180 remains substantially avoided (see FIGS. 1 and 2).

Of note is the fact that the pathway through the gate mechanism 200 is made up of the above noted seat 225 and a fluid channel 325. Further, in the embodiment as illustrated, communication between the uphole 310 and downhole 320 chambers may be achieved through the pathway of the gate mechanism 200 once the fluid channel 325 is aligned with a downhole channel 330. However, with the gate mechanism 200 held in position as depicted in FIG. 3A, the fluid channel 325 is prevented from reaching the downhole channel 325 and the uphole 310 and downhole 320 chambers remain substantially isolated relative to one another.

With added reference to FIG. 1, the chambers 310, 320 are substantially isolated from one another as described above. However, upon advancing of the assembly into the depths of the well 180, the pressure within the coiled tubing 155 near the BCBV 100 may build. That is, with an increasing height of the coiled tubing 155 into the well 180, the hydrostatic pressure at the end of the fluid filled coiled tubing 155 rises. Thus, pressure within the sealed off uphole chamber 310 also rises due to being in communication with the coiled tubing 155. This rise in hydrostatic pressure within the uphole chamber 310 may continue as the assembly achieves greater and greater well depths. However, once positioned at a predetermined depth, the BCBV 100 may be configured to allow partial communication between the uphole 310 and downhole 320 chambers as described below.

Continuing with reference to FIG. 3A, a downhole piston assembly 275 is provided with a downhole piston arm 355 held in the position by a conventional spring within a chamber. A leak point 340 allowing partial fluid communication between the uphole 310 and downhole 320 chambers may be present depending on the position of the downhole piston arm 355. That is, the uphole chamber 310 may be in fluid communication with the downhole piston arm 355. Thus, as depicted in FIG. 3A, the above noted build up of hydrostatic pressure within the uphole chamber 310 may be sufficient to overcome the force of the spring and shift the downhole piston arm 355 in a downhole direction. This occurs once enough depth into the well 180 of FIG. 1 is achieved. With this in mind, the spring of the downhole piston assembly 275 may be selected as one that is compressible in response to a predetermined amount of pressure corresponding to the desired well depth as noted.

Once positioned as shown in FIG. 3A, with a slight degree of communication provided between the uphole 310 and downhole 320 chambers, an influxing flow of fluid 260 may be delivered to the uphole chamber 310. With added reference to FIGS. 1 and 3B, this influxing fluid 260 may be provided to the assembly through the coiled tubing 155 via surface equipment 150 at the oilfield 115. In response to the influx of fluid 260 the head and uphole piston arm 350 of the uphole piston assembly 250 shift to the right as forces of its underlying spring are overcome. That is, the spring of the uphole piston assembly 250 may also be selected based on a compressible nature in response to a predetermined flow rate as provided by the influxing fluid 260.

Continuing with reference to FIG. 3B, the shift of the uphole piston arm 350 to the right as described above may be used to achieve rotation of the gate mechanism 200 to the depicted position. In the position shown, the pathway through the gate mechanism 200 includes locating of the fluid channel 325 into alignment with the downhole channel 330. Similarly, the seat 225 of the gate mechanism 200 has been rotated into alignment with the uphole chamber 310. As such, the influxing fluid 260 may be routed through the pathway in the gate mechanism 200 from the uphole chamber 310 to the downhole chamber 320 via the downhole channel 330. In this manner, a substantially free flow of fluid 260 through the BCBV 100 may be achieved.

Continuing with reference to FIG. 3B, the above noted ballistic actuator 300 may be provided to the coiled tubing 155 at the surface of the oilfield 115 of FIG. 1 such that the flow of fluid 260 is employed to carry the actuator 300 downhole. In the embodiment shown, the ballistic actuator 300 is a conventional spherical ball of between about ¼" and about 1" in outer diameter. Alternatively, non-spherical actuator configurations may be employed. The actuator 300 may be of stainless steel, rubber, polyetheretherketone (PEEK) or other suitable material. Additionally, the BCBV 100 itself may have an outer diameter of greater than about 2" with an inner diameter of at least about 1" to accommodate the ballistic actuator 300 therethrough.

Regardless of the particular sizing or materials selected, the ballistic actuator 300 may be configured to ride the flow of fluid 260 downhole until reaching the gate mechanism 200. With continued reference to FIG. 3B, the ballistic actuator 300 ultimately traverses the uphole chamber 310 to reach the seat 225 of the gate mechanism 200. At this point, the flow of fluid 260 through the gate mechanism 200 may be occluded by the actuator 300 itself. Thus, with the compression of the uphole 250 and downhole 275 piston assemblies already substantially achieved, a detectable spike in pressure within the uphole chamber 310 may result. Nevertheless, a small degree of fluid communication between the uphole 310 and downhole 320 chambers may be present through the intentional leak point 340 as pointed out in FIG. 3A, so as to avoid sudden pressure spiking to a degree harmful to the assembly or the surface equipment 150 shown in FIG. 1.

Continuing now with reference to FIG. 3C, in response to the detected spike in pressure within the uphole chamber 310, pumping of fluid 260 into the assembly may be halted. This may be achieved manually or in an automated manner through control of pumps at the surface of the oilfield 115 (see FIG. 1). Regardless, the cessation of pumping of fluid 260 may allow the spring of the uphole piston assembly 250 to return to form. In this manner, the uphole piston head and arm 350 may be shifted uphole, guiding rotation of the gate mechanism 200 as shown. As a result, the ballistic actuator 300 may be transferred to communication with the downhole chamber 320. Thus, the actuator 300 may be dropped into the downhole chamber 320 and proceed further downhole to a ballistically actuated downhole tool such as a perforating gun 187 with a firing head 170 (see FIGS. 4 and 5).

As described above, pressure within the uphole chamber 310 is decreased so as to release the ballistic actuator 320 into the downhole chamber 320. However, the timing for release of the ballistic actuator 320 into the downhole chamber 320 may be a matter of operator determination. For example, in an embodiment where a ballistically actuated downhole tool is not ready to receive the ballistic actuator 300 from the BCBV 100, an operator may allow the pressure within the uphole chamber 310 to remain high enough so that the gate mechanism 200 retains the actuator 300 for a period of time. That is, the operator may determine the appropriate time for release of the actuator 300 from the gate mechanism 200 based on other information, perhaps obtained from the ballistically actuated downhole tool or another location. Thus, embodiments herein allow for an added degree of precision in the timing of firing of a ballistically actuated downhole tool.

Once the ballistic actuator 300 is provided to the downhole chamber 320 as described above, pumping may again proceed, for example to achieve further rotation of the gate mechanism 200. This may be done in order to attain a controlled flow of fluid 260 through a pathway thereof with the gate mechanism 200 oriented as depicted in FIG. 3B (but without the presence of an occluding ballistic actuator 300). That is, the fluid channel 325 may be aligned with the downhole channel 330 as described above to allow a smooth and controlled flow of fluid 310 through the entire BCBV 100 where desired.

Figure 4A:
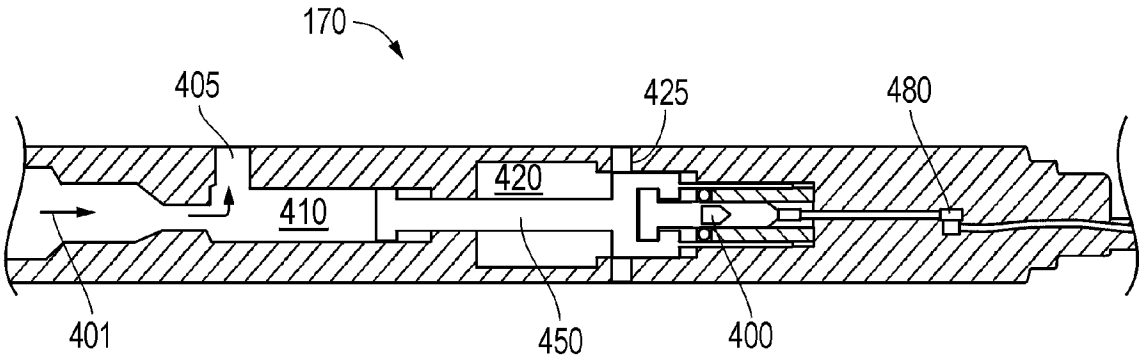
FIG. 4A is a side cross-sectional view of an embodiment of a firing head of the ballistically compatible backpressure valve of FIG. 2.
Figure 4B:
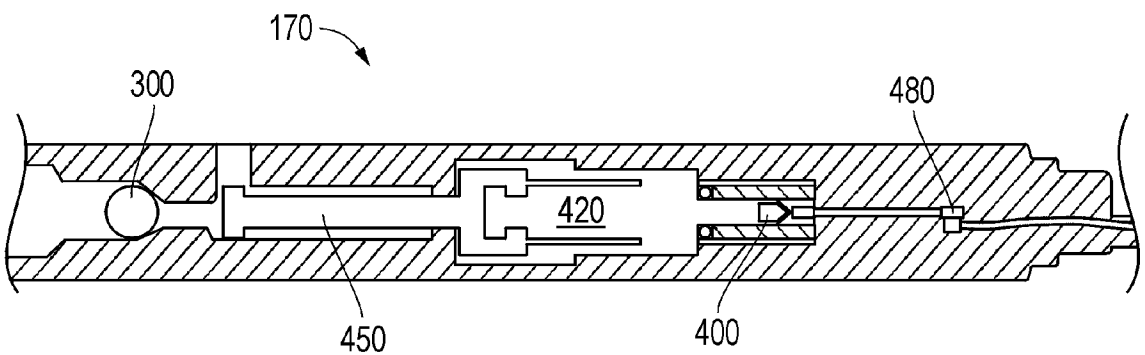
FIG. 4B is a side cross-sectional view of the firing head of FIG. 4A receiving the ballistic actuator of FIG. 3C.

Referring now to FIGS. 4A and 4B, with added reference to FIG. 1, a firing head 170 of a perforating gun 187 is depicted. In FIG. 4A, the firing head 170 is shown with a circulation fluid 401 maintaining pressure within an uphole compartment 410. A portion of the circulation fluid 401 may be vented out a circulation port 405 at the side of the uphole compartment 410. However, enough pressure is maintained within the compartment 410 by the circulation fluid 401 so as to ensure that a firing piston 450 is kept in place. However, once the above described ballistic actuator 300 reaches a seat uphole of the compartment 410 as depicted in FIG. 4B, the circulation fluid 401 may be occluded from entering the compartment 410. As a result, pressure within the uphole compartment 410 may be reduced.

Continuing with reference to FIG. 4B, pressure within the uphole compartment 410 may ultimately be reduced to a point lower than pressure within a downhole compartment 420 of the firing head 170. As such, shear pins 425 may no longer be able to retain the firing piston 450 in the position depicted in FIG. 3A. Thus, as shown in FIG. 4B, the firing piston 450 may shift uphole to occupy the low pressure uphole compartment 410. As this occurs, the firing pin 400 may be released, ultimately setting off a ballistically actuated downhole tool (see the perforating gun 187 of FIG. 5). That is, in the embodiment shown, the firing pin 400 may be released, striking a signal transfer line 480 which carries a firing signal into the perforating gun 187 of FIG. 5.

Figure 5:
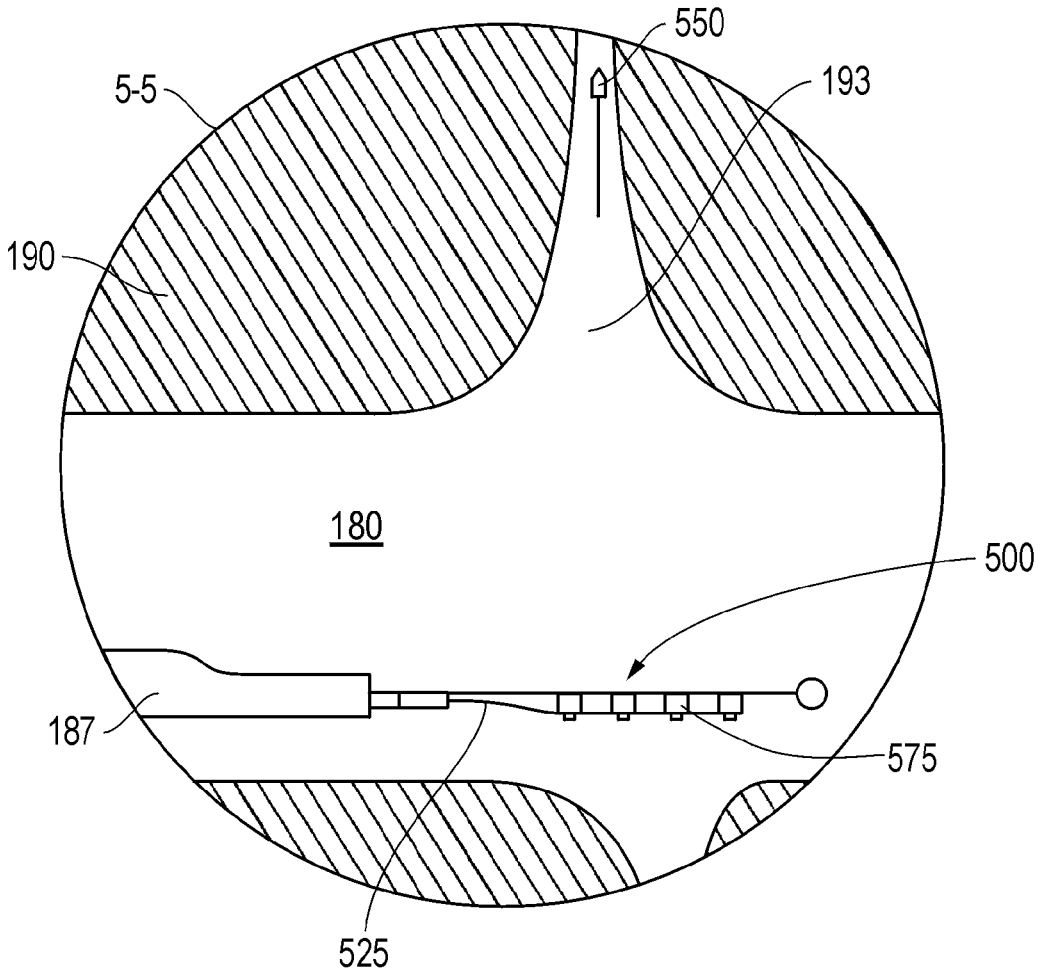
FIG. 5 is an enlarged view of an embodiment of a perforating gun taken from 5-5 of FIG. 1 and configured for actuation by the firing head of FIGS. 4A and 4B.

Continuing now with reference to FIG. 5, the above described perforating gun 187 is shown within the well 180, having fired a charge 550 into the formation 190 in order to form a perforation 193. The perforation 193 may exceed about 1 foot into the formation 190 so as to aid in hydrocarbons recovery therefrom. The charge 550 may be fired from one of a variety of caps 575 at the end of a gun extension 500. In the embodiment shown, a single perforation 193 is formed. However, anywhere from about 2 to about 10 shots per foot may be fired by caps 575 of a gun extension 500. The caps 575 themselves may be directed for firing by the above noted signal from the firing head 170 of FIG. 4. This signal may be carried to the caps 575 by way of a conductive strip 525 running across the gun extension 500 to each of the caps 575.

Figure 6:
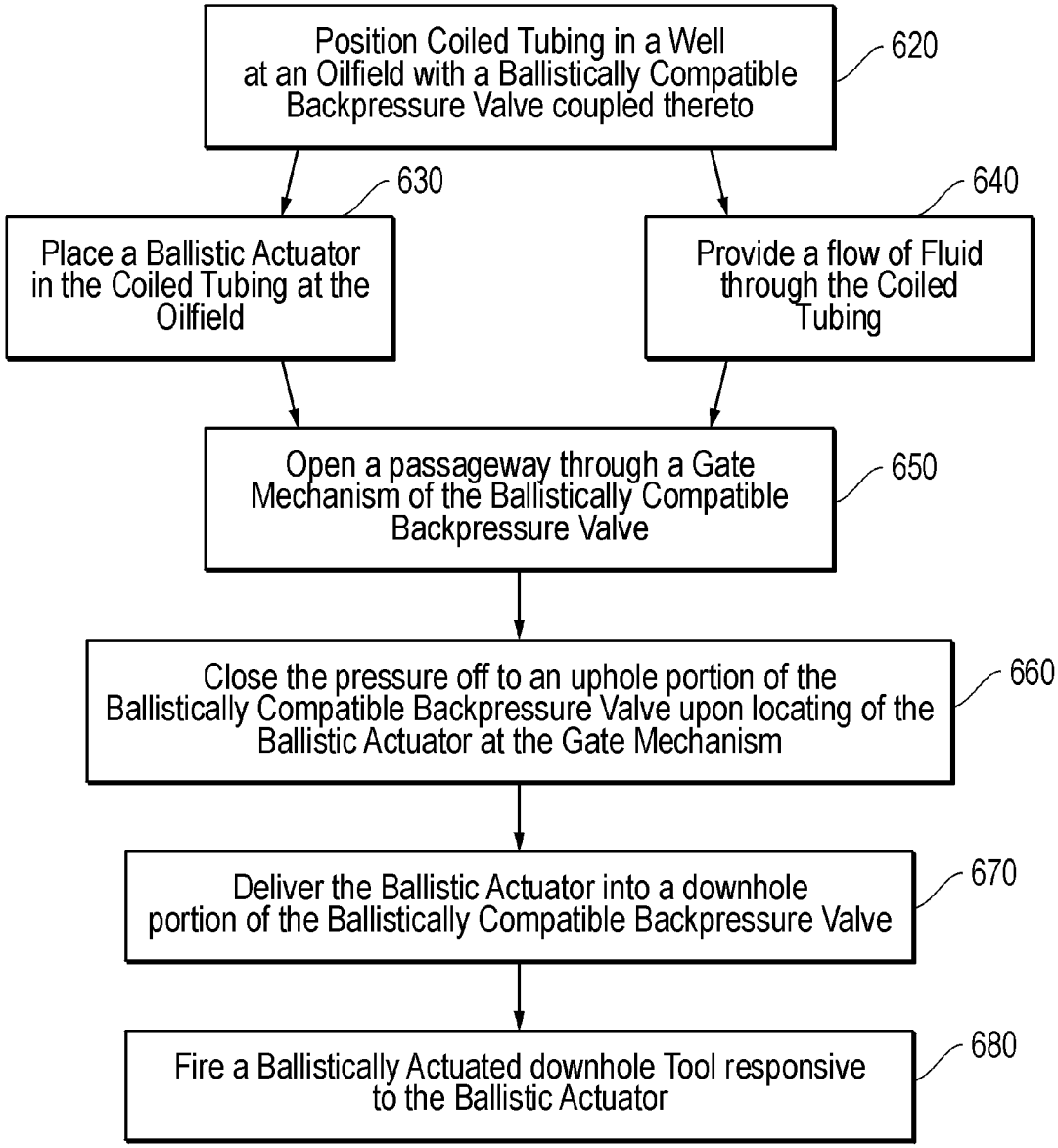
FIG. 6 is a flow-chart summarizing an embodiment of employing a ballistically compatible backpressure valve in a coiled tubing assembly.

Referring now to FIG. 6, a flow-chart summarizing an embodiment of employing a ballistically compatible backpressure valve for a coiled tubing assembly is depicted. In accordance with embodiments described above, coiled tubing is positioned in a well at an oilfield. The coiled tubing includes a ballistically compatible backpressure valve coupled thereto as detailed above (see 620). Once in place, the backpressure valve may serve to substantially maintain controlled pressure within the coiled tubing. Additionally, a ballistic actuator may be placed in the coiled tubing as indicated at 630 and a flow of fluid provided through the coiled tubing as indicated at 640.

In accordance with the providing the ballistic actuator and fluid flow to the coiled tubing, a passageway through a gate mechanism of the backpressure valve may be opened as indicated at 650. However, upon locating of the ballistic actuator at the gate mechanism, the passageway may be closed off to uphole portions of the assembly as indicated at 660. Thus, as noted at 670, the ballistic actuator may be delivered to a downhole portion of the assembly as pressure uphole of the gate mechanism continues to be maintained in a substantially controlled manner. Once delivered to the downhole portion, the ballistic actuator may continue downhole to trigger the firing of a ballistically actuated downhole tool as indicated at 680.

Embodiments described hereinabove include a backpressure valve disposed between the terminal end of coiled tubing and a ballistically actuated downhole tool and include the ability to provide pressure control to the coiled tubing without sacrifice to ballistic actuation of the downhole tool. This may be achieved for downhole tools that require an actual mechanical projectile or ballistic actuator as opposed to mere hydraulic actuation. Thus, embodiments disclosed herein allow for the use of a ballistically actuated downhole tool even in circumstances where a pressure differential between the well and the coiled tubing therein is significant enough to require use of a truly effective backpressure valve.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, embodiments depicted herein reveal a ballistically compatible backpressure valve for use with a ballistically actuated downhole tool in the form of a perforation gun. However, other forms of ballistically actuated downhole tools may be employed with such a backpressure valve, including ballistically actuated circulation valve, inflatable packer setting valves, coiled tubing disconnection assemblies, and shifting tools. Furthermore, the foregoing description should not be read as pertaining only to the precise structures described and shown in the accompanying drawings, but rather should be read as consistent with and as support for the following claims, which are to have their fullest and fairest scope.

We claim:

1. A backpressure valve to substantially maintain controlled pressure in coiled tubing disposed within a well, the backpressure valve comprising:

a housing having an uphole portion for coupling to the coiled tubing and a downhole portion for coupling to a downhole tool; and a gate mechanism disposed within said housing for receiving a ballistic actuator from within the uphole portion and for dispensing the ballistic actuator to within the downhole portion for actuation of the downhole tool.

2. The backpressure valve of claim 1 wherein said gate mechanism includes a fluid pathway there through and is configured to orient the pathway in one of:

a closed position to substantially prevent a flow of fluid from the uphole portion to the downhole portion; and an open position to substantially allow the flow of fluid from the uphole portion to the downhole portion in absence of the ballistic actuator.

3. The backpressure valve of claim 2 wherein the receiving takes place with the pathway in the open position and the dispensing takes place with the pathway in the closed position.

4. The backpressure valve of claim 2 wherein the pathway includes a seat for the receiving.

5. The backpressure valve of claim 2 wherein the controlled pressure differs from a pressure within the well by between about 500 PSI and about 4,000 PSI.

6. The backpressure valve of claim 2 wherein the gate mechanism includes a cam with the pathway there through, the cam for rotating between the closed position and the open position.

7. The backpressure valve of claim 6 wherein the uphole portion includes an uphole chamber of a given flow rate there through to direct the rotating.

8. The backpressure valve of claim 7 wherein the rotating to the open position is responsive to an increase in the given flow rate and the rotating to the closed position is responsive to a reduction in the given flow rate.

9. The backpressure valve of claim 7 wherein the downhole portion includes a downhole chamber housing a downhole piston assembly configured to allow partial communication between the uphole and downhole chambers based on the given pressure.

10. A coiled tubing assembly for disposing downhole in a well and comprising:

coiled tubing;

a ballistically actuated tool; and a ballistically compatible backpressure valve disposed between said coiled tubing and said ballistically actuated tool to substantially maintain a controlled pressure in said coiled tubing and to allow a ballistic actuator to pass from within said coiled tubing to said ballistically actuated tool.

11. The coiled tubing assembly of claim 10 wherein said ballistically compatible backpressure valve comprises:

an uphole portion coupled to said coiled tubing;

a downhole portion coupled to said ballistically actuated tool; and a gate mechanism disposed between said uphole portion and said downhole portion for receiving the ballistic actuator from said uphole portion and for dispensing the ballistic actuator to within the downhole portion.

12. The coiled tubing assembly of claim 10 wherein said ballistically actuated tool is one of a perforating gun, a circulation valve, an inflatable packer setting valve, a coiled tubing disconnect assembly and a shifting tool.

13. The coiled tubing assembly of claim 12 wherein the perforating gun includes a firing head for accommodating the ballistic actuator.

14. The coiled tubing assembly of claim 13 wherein the firing head is configured to signal the perforating gun for the firing upon the accommodating.

15. The coiled tubing assembly of claim 10 wherein the ballistic actuator is up to about 1 inch in outer diameter.

16. The coiled tubing assembly of claim 10 wherein the ballistic actuator is of a material selected from a group consisting of stainless steel, rubber, and polyetherether ketone.

17. A method of ballistically actuating a tool of a coiled tubing assembly in a well, the method comprising:

providing a flow of fluid through coiled tubing of the coiled tubing assembly;

opening a passageway for the fluid through a gate mechanism in a backpressure valve coupled to the coiled tubing;

disposing a ballistic actuator in the coiled tubing;

closing off the passageway to an uphole portion of the backpressure valve upon locating of the ballistic actuator at the gate mechanism; and delivering the ballistic actuator to a downhole portion of the backpressure valve.

18. The method of claim 17 further comprising terminating said providing upon said closing.

19. The method of claim 17 wherein said delivering further comprises:

positioning the ballistic actuator at a firing head of the tool; and actuating the tool in response to a signal from the firing head generated by said positioning.

20. The method of claim 19 wherein the tool is one of a perforating gun, a circulation valve, an inflatable packer setting valve, a coiled tubing disconnect assembly and a shifting tool.

21. A method of conveying a mechanical projectile downhole in a coiled tubing assembly positioned in a well, the method comprising:

opening a passageway in a gate mechanism of the assembly coupled to a terminal end of coiled tubing of the assembly;

advancing the mechanical projectile through the coiled tubing to within the gate mechanism;

closing the passageway to the coiled tubing;

delivering the mechanical projectile to a portion of the assembly downhole of the gate mechanism.

22. The method of claim 21 further comprising maintaining a substantially controlled pressure within the coiled tubing prior to said opening.

23. The method of claim 22 wherein the substantially controlled pressure differs from a pressure within the well by between about 500 PSI and about 4,000 PSI.

* * * * *